US006674346B2

(12) United States Patent
Snyder et al.

(10) Patent No.: US 6,674,346 B2
(45) Date of Patent: Jan. 6, 2004

(54) EVANESCENT RESONATORS

(75) Inventors: Richard V. Snyder, Kinnelon, NJ (US); Edip Niver, Westfield, NJ (US); Keehong Um, Ramsey, NJ (US); Sanghoon Shin, Ridgefield, NJ (US)

(73) Assignee: New Jersey Institute of Technology, Newark, NJ (US)

( * ) Notice: Subject to any disclaimer, the term of this patent is extended or adjusted under 35 U.S.C. 154(b) by 0 days.

(21) Appl. No.: 10/159,497

(22) Filed: May 31, 2002

(65) Prior Publication Data

US 2003/0189469 A1 Oct. 9, 2003

Related U.S. Application Data

(60) Provisional application No. 60/371,210, filed on Apr. 9, 2002.

(51) Int. Cl.[7] ..... H01P 1/219
(52) U.S. Cl. ..... 333/210; 333/219
(58) Field of Search ..... 333/202, 208, 333/210, 212, 227, 219, 204

(56) References Cited

U.S. PATENT DOCUMENTS 4,291,287 A * 9/1981 Young et al. ..... 333/210
6,154,106 A * 11/2000 De Lillo ..... 333/210

* cited by examiner

*Primary Examiner*—Seungsook Ham
(74) *Attorney, Agent, or Firm*—Klauber & Jackson

(57) ABSTRACT

A evanescent resonator device includes a short-circuited evanescent waveguide and loading capacitor. The evanescent waveguide of the resonator includes a single length of evanescent transmission line terminated in short circuit, a first support substrate having a predetermined dielectric constant, the first support substrate having a top surface and a bottom surface; a dielectrically loaded feed network including: (a) a second substrate arranged on the top surface of the first support substrate, the second substrate having a predetermined dielectric constant that is higher than the first support substrate; and (b) a metal strip arranged on an upper surface of the second substrate, so that the second substrate is arranged between the first support substrate and the second substrate. A ground plane is arranged on the bottom surface of the first support substrate, the support substrate includes a hollow metalized center area being open on an upper end closest to the second substrate. A ratio of the predetermined dielectric constants of said second substrate to said first support substrate ranges from approximately 2 to 200 so to permit reduced size because of the reduction in required capacitance without a reduction in Q value.

63 Claims, 12 Drawing Sheets

$$C := \frac{\Theta}{\Pi \cdot \omega_0 \cdot Z_0}$$

$$L := 2 \cdot \Theta \cdot \frac{Z_0}{\Pi \cdot \omega_0}$$

EVANESCENT RESONATORS

This application claims priority from U.S. provisional application No. 60/371,210 filed Apr. 9, 2002.

BACKGROUND OF THE INVENTION

1. Field of the Invention

The field of the present invention is related to resonators, particularly resonators that can be combined into filter structures. More particularly, the present invention relates to evanescent resonators.

2. Description of the Related Art

Resonators are known in the art as devices comprising conductive enclosures, cavities, or wave transmission line sections of a two terminal type. The inductance and capacitance is typically distributed, and the line sections being terminated in other than the characteristic impedance of the line sections, so that the device exhibits resonant characteristics to the existing source of wave energy. Resonators can be used to form band pass/band stop filters to permit/block transmission of a particular range of frequency signals, and filter out unwanted frequencies or noise that can be present in the microwave signals. The resonator cavity is normally designed to have a predetermined cross sectional shape so as to permit resonance at a particular desired frequency. Evanescent resonators are typically constructed from lengths of below-cutoff (e.g. dispersive) transmission line with the resonators formed by posts, capacitive screws, ridges, etc. U.S. Pat. Nos. 6,137,383 and 6,154,106 (which are hereby incorporated by reference as background material) to De Lillo disclose multilayer evanescent resonator devices using via hole technology, wherein the resonator is constructed of dielectric material with resonator holes, that may or may not be filled with air or another gas. There are a plurality of resonators arranged in a single device, typically in an array, that are internally connected.

SUMMARY OF THE INVENTION

An evanescent resonator according to an aspect of the present invention includes a single length of evanescent transmission line, terminated in short circuit, and filled with air or a low dielectric constant, and supported by air or a low dielectric constant material. The evanescent resonator is fed by surface wave lines operating at relatively low frequency, which have been dielectrically loaded with a material having a dielectric constant higher than the low dielectric material either filling the evanescent line or supporting the evanescent line. The dielectric constant of the low dielectric material can range approximately from values of 2 to 10. The high dielectric may have a dielectric constant ranging approximately from 4 to 400, although typically 10 to 90 may be preferable, depending on the specific need. Thus, the ratio of the high dielectric constant to low dielectric constant may range, for example from 2 to 200, depending upon the specific dielectric constant of the materials selected. There may be many different values, high or lower, which are particularly dependent upon the dielectric constant of the materials.

According to another aspect of the present invention, the dielectric loading of the surface wave or other feed line permits simulation of the effect of higher frequencies present at the input to evanescent resonators, by decreasing the wavelength to that of the simulated high frequency. Thus, a small evanescent resonator is able to support excitation by the relatively low frequency rather than the high frequency, without requiring compensation by the use of a large resonating capacitor. The incoming wave needs to be foreshortened relative to the wavelength in the medium filling the evanescent section.

According to another aspect of the invention, the evanescent resonator is an individual resonator connected externally to a feed network and wave guiding structure. The feed network is reduced in size by dielectric loading so that the wavelength of the feed network is not much larger than the cutoff wavelength of the resonator structure. One advantage of this aspect of the present invention is that the evanescent resonator is operable at frequencies near (but below) cutoff, but without the reduction in unloaded Q intrinsic to waveguide structures known heretofore.

According to an aspect of the invention, dielectric-loaded feed lines (for example, surface wave lines similar to Goubau lines) and below cutoff air-filled cavities can be used to form L-C sections. The capacitance in the L-C sections is primarily from electric field coupling of the feed line dielectric into the below-cutoff section. The inductance results from a combination of inductors in the inductive tee-equivalent circuit for such below-cutoff sections.

According to an aspect of the present invention, dielectric loading is used to shorten the guide wavelength at the input to the evanescent section, so as to increase the effective input inductance. The dielectrically-loaded feed lines may comprise microstrip, CPW, CPS and surface wave structures (Goubau lines), waveguides, etc. The resulting resonant elements according to the present invention are operable at frequencies below 1 GHz with small dimensions.

According to still another aspect of the present invention, the effective unloaded Q for resonators is approximately 400, a significant improvement over evanescent resonators known in the art, for resonators of such small size and low frequency operation.

The evanescent resonators can be connected together into any sort of filter arrangement. Each of the individual resonators contain a section having a closed conductive wall, and this section, while shown in the drawings to be cylindrical, may be any shape (elliptical, rectangular, free form, etc.). One difference in the various possible shapes is the response may be more simple to calculate in some shapes than others.

DETAILED DESCRIPTION OF THE INVENTION

The following description is presented for purposes of illustration, not for limitation. A skilled artisan understands that there are variations to the description of the invention that do not depart from the spirit of the invention and the scope of the appended claims.

In a first aspect of the present invention, resonant cavities can be micro-machined into a substrate. The substrate may be a Ad silicon substrate, but the use of silicon is not an absolute requirement. The cavities will operate as evanescent mode Lit inductors, and will resonate when combined with capacitance that effectively results from electric field coupling between the open end of the evanescent section and the high dielectric constant material forming a portion of the lines that feed the evanescent section.

Figure 1A:
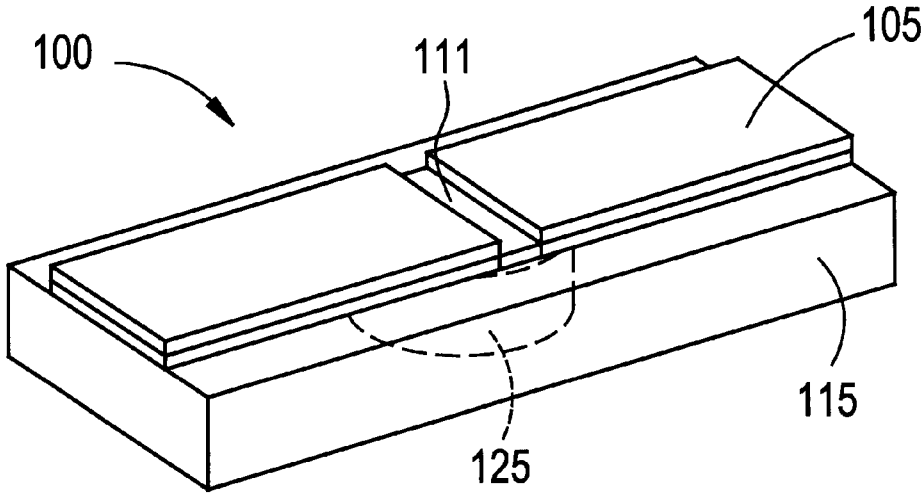
FIGS. 1A and 1B show a first aspect of the evanescent resonator according to the present invention, arranged as a bandpass resonator.
Figure 1B:
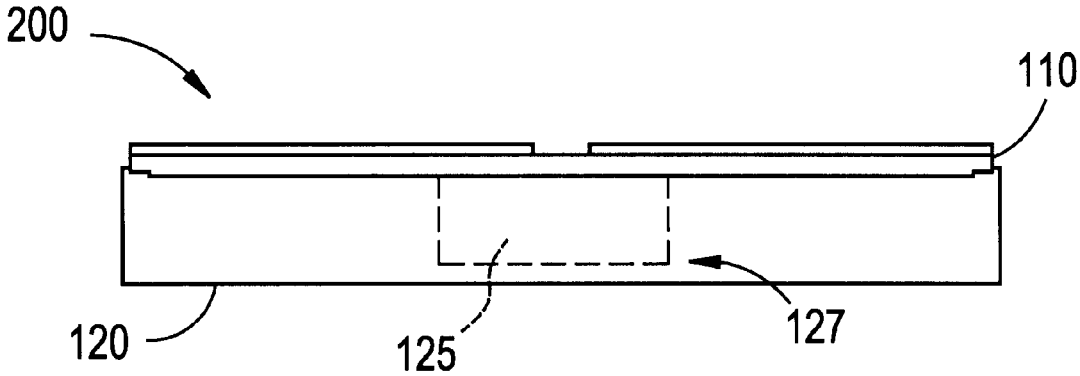

FIGS. 1A and 1B illustrate one way that a basic structure and suspended resonator may look according to the present invention. FIG. 1A, which is a perspective view of an evanescent suspended bandpass resonator (series transmission pole) according to the present invention, shows that a metal strip (conductor) feed line 105 is arranged across the top of a high dielectric constant substrate 110 (better shown in FIG. 1B), so to cause most of the energy to be bound by the high-dielectric constant substrate, with the wavelength set by the dielectric constant of the substrate.

As can be seen from FIG. 1B, there is a gap 111 provided in the metal strip for DC isolation. The high dielectric constant substrate 110 is arranged on a low dielectric substrate support 115, so as to separate the metal strip conductor 105 from the low dielectric. Below the low dielectric substrate 115 is a ground plane 120, arranged at an opposite end of the metal strip conductor 105. A hollow air metalized cylinder 125 is arranged in an area of the low dielectric substrate. It should be noted that according to an aspect of the present invention, there is a gap 127 between the cylinder and the ground plane 120. Arranging the metalized cylinder above the ground plane with a gap provides a series resonant circuit.

Figure 2A:
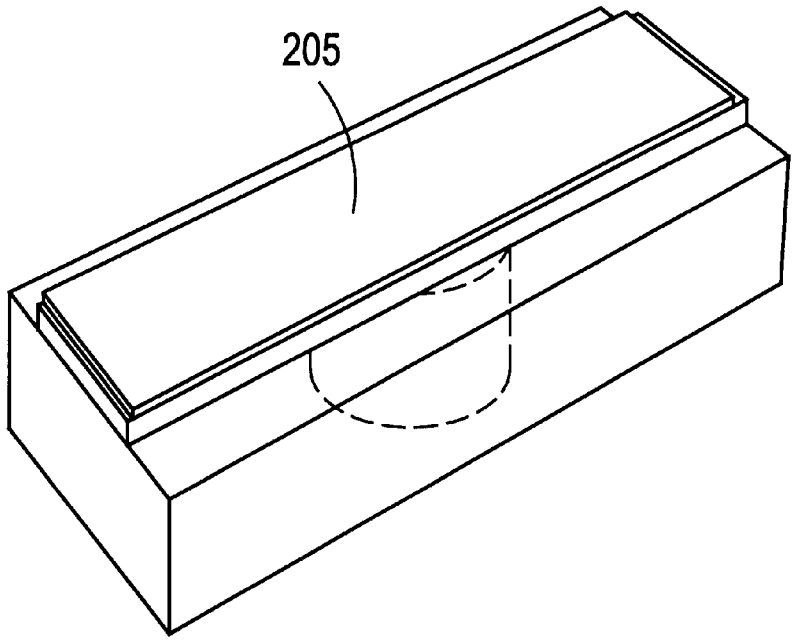
FIGS. 2A and 2B illustrate another aspect of the evanescent resonator according to the present invention, arranged as a bandstop resonator.
Figure 2B:
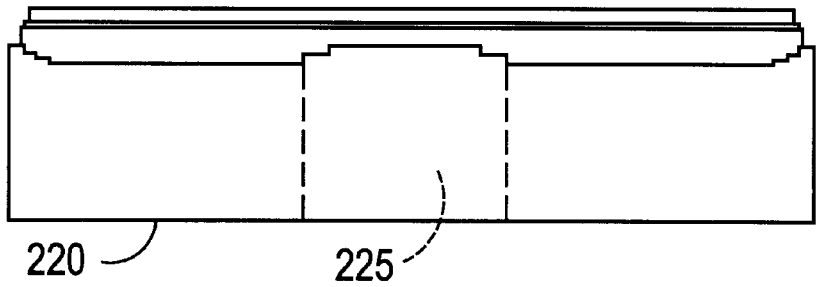

FIGS. 2A and 2B illustrate another evanescent resonator 200 according to the present invention. The resonator 200 operates an evanescent suspended bandstop resonator (shunt transmission zero). Arranging the metalized cylinder directly in contact with the ground plane (i.e. no gap between the cylinder 227 and ground plane 220) provides a transmission zero. In this particular resonator, it can be seen from FIG. 2A that the metal strip feed line 205 does not have a gap in the top (such as 111 in FIG. 1A), there is no gap between the cylinder 225 and the ground plane 220.

The relatively high dielectric constant substrate (approximately greater than 10) is recommended to eliminate radiative losses from the metal strip feed line, and thus ensures low-loss transmission of energy.

In both FIGS. 1 and 2, the metalized cylinders have an open end, and the resonators will resonate when combined with capacitance effectively resulting from an electric field coupling between the open end of the evanescent section and the high dielectric constant material forming a portion of the lines feeding the evanescent section.

It should be noted that, while typically, the high dielectric constant substrate 110 may have an Er ranging approximately from 2 to 4.5 to 400, values both higher and lower than this range may be used. The low dielectric constant substrate should have an Er ranging from approximately 2.0 to 2.2, but there can be both higher and lower values.

The resonators in FIGS. 1 and 2 can be connected to implement either bandpass (series transmission pole) or bandstop (shunt transmission zero) equivalent circuits. The effective inductance of any below cutoff section (cylindrical in the illustration, can also be rectangular, ellipitical, etc, other shapes according to need so long as they display dispersion and a high pass cutoff characteristic) results because the cutoff wavelength for the section is shorter than the incident signal wavelength. According to this new approach, the high dielectric constant loading is used to modify the incident signal wavelength, thereby reducing the difference between the cutoff wavelength and the incident signal wavelength. IF not for the reduction in signal wavelength resulting from dielectric loading, the effective series inductance in the equivalent circuits shown above would be lower, and more resonating capacitance would be needed, in either the series or shunt case, for a particular resonant frequency. The equivalent series inductance is proportion to the square root of the substrate dielectric constant.

Figure 3A:
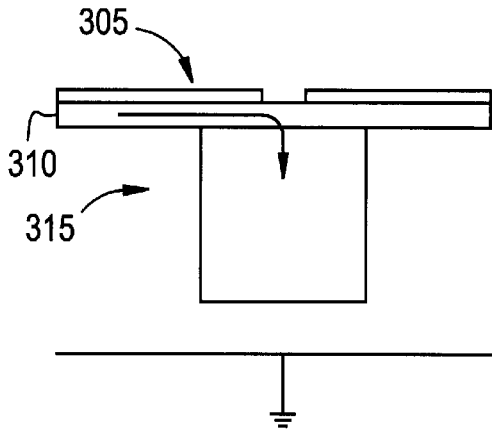
FIGS. 3A to 3D illustrate equivalent circuit schematics for the bandpass and bandstop resonators.
Figure 3B:
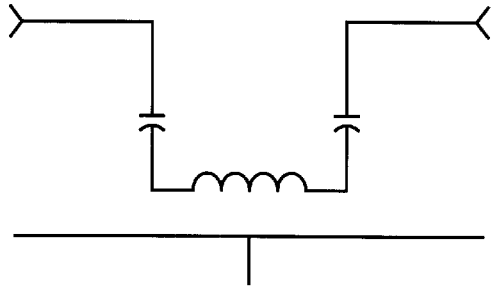
Figure 3C:
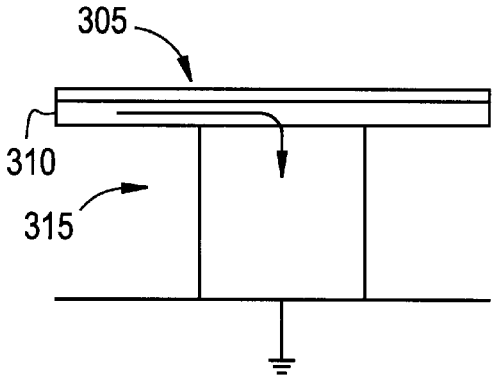
Figure 3D:
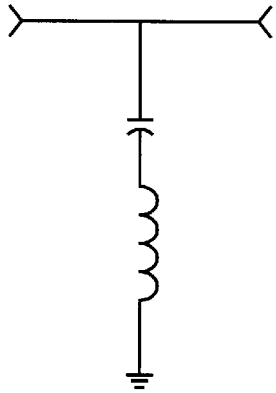

FIGS. 3A through 3D show equivalent circuit elements for the bandpass resonator shown in FIGS. 1A and 1B, and the bandstop resonator shown in FIGS. 2A and 2B. As shown in FIG. 3A, the metal strip 305, which has a gap 311, is arranged on top of the high Er substrate 310 arranged on top of the low dielectric substrate 315 has the equivalent circuit shown in FIG. 3B. FIG. 3C similarly shows a bandstop resonator having a similar configuration except there is no gap in the metal strip, and the arrangement of the cylinder (not shown in FIG. 3) is similar to as shown in FIG. 2B. The resonance effect results from the "Equivalent Frequency" principle, by which it is recognized that a below-cutoff section is below cutoff to the wavelength of energy incident upon it, not to a given frequency. The reactance of the below cutoff section is dependent on the ratio of the wavelength of the incident energy ($\lambda_g$) to the cutoff wavelength for the section ($\lambda_c$). Thus, the shortening of the incident wavelength through the use of dielectric loading enables the below cutoff section to be effectively closer to cutoff, and thus more easily excited. The tee-equivalent series inductance is increased so as to enable resonance with a smaller capacitance for a particular resonant frequency, the size of which was heretofore unknown for such types of resonator structures.

Figure 4A:
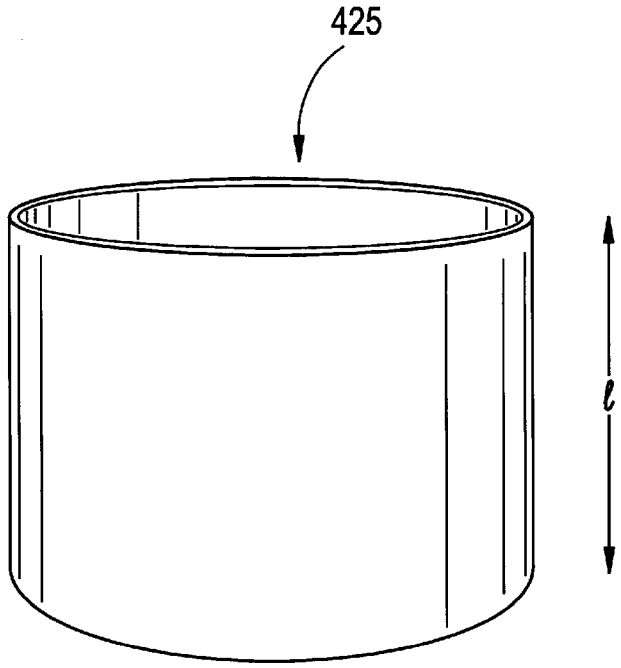
FIG. 4 illustrates the hollow metalized wall and bottom below-cutoff cross section, and the equivalent circuit for a single mode below cutoff.
Figure 4B:
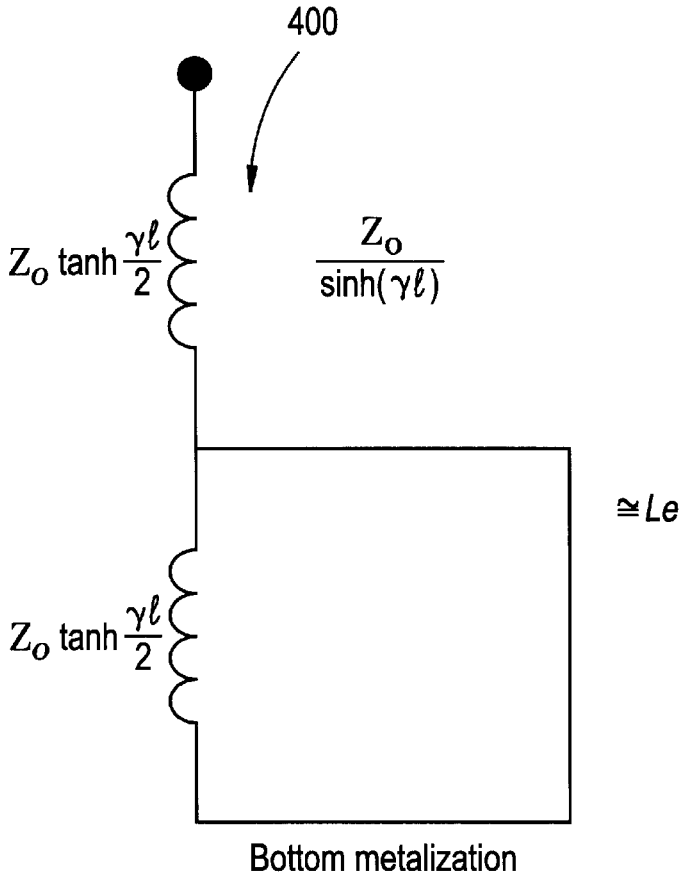

FIGS. 4A and 4B illustrate the metalized wall (in this particular embodiment, cylindrically-shaped but this shape is not required) and bottom bellow-cutoff cross section. The equivalent circuit is a short circuited tee.

The following equations are presented to illustrates that the tee-equivalent inductance is increased so as to enable resonance with a smaller capacitor for a particular resonant frequency. The inductances stem from the single mode tee-equivalent circuit shown in FIGS. 3B and 4B:

$$L_e = Z_o \tanh\left(\frac{\gamma l}{2}\right) + \frac{Z_o^2 \tanh\left(\frac{\gamma l}{2}\right)}{Z_o \tanh\left(\frac{\gamma l}{2}\right) + \frac{Z_o}{\sinh(\gamma l)}} \tag{1-1}$$

$Z_o$ (for round cross section sector with cut-off wave length of $\lambda c$)

$$Z_o = \frac{377}{\sqrt{\left(\frac{\lambda g}{\lambda c}\right)^2 - 1}} \tag{1-2}$$

$$\gamma = \left(\frac{6.28}{\lambda g}\right)\sqrt{\left(\frac{\lambda g}{\lambda c}\right)^2 - 1} \tag{1-3}$$

The values of Zo & from [2], and guide wavelength from the dielectric constant in the surface wave feed lines.

$$C = \frac{2\pi\varepsilon_r\varepsilon_o r\sqrt{4d^2 + r^2}}{\sqrt{4d^2 + r^2} - r} \tag{1-4}$$

r=radius of cylinder, d=thickness of dielectric layer in surface wave line structure, C is effective total circuit static capacitance.

Figure 5A:
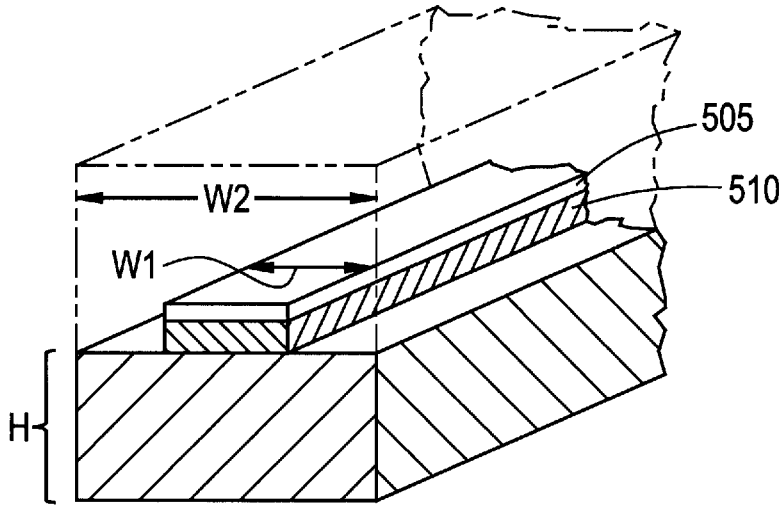
FIGS. 5A and 5B illustrate the differences in enclosure width, line and dielectric widths, and support substrate thickness, according to an aspect of the present invention.
Figure 5B:
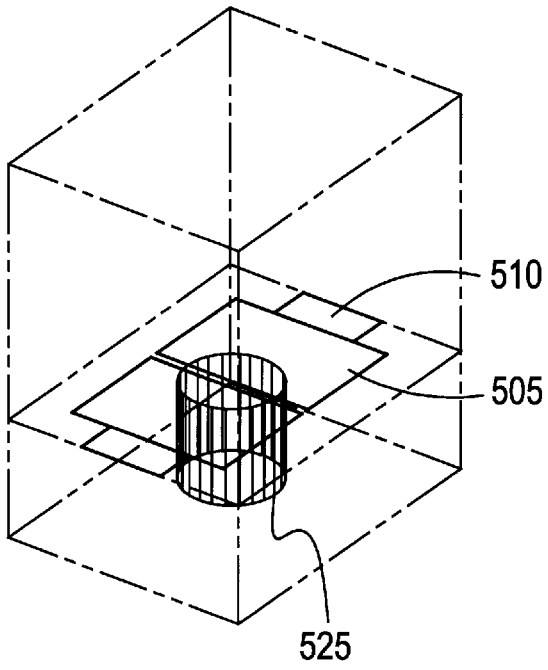

FIG. 5A illustrates one embodiment of a resonator according to the present invention. It can be seen that the surface line configuration enclosure width is W2, the high dielectric 510 and metal strip or line 505 are width W1, and the support thickness is designated by H. For a surface wave, H>W1. FIG. 5B illustrates a perspective view wherein the metal strip 505 is wider than the high dielectric substrate 510.

Figure 6:
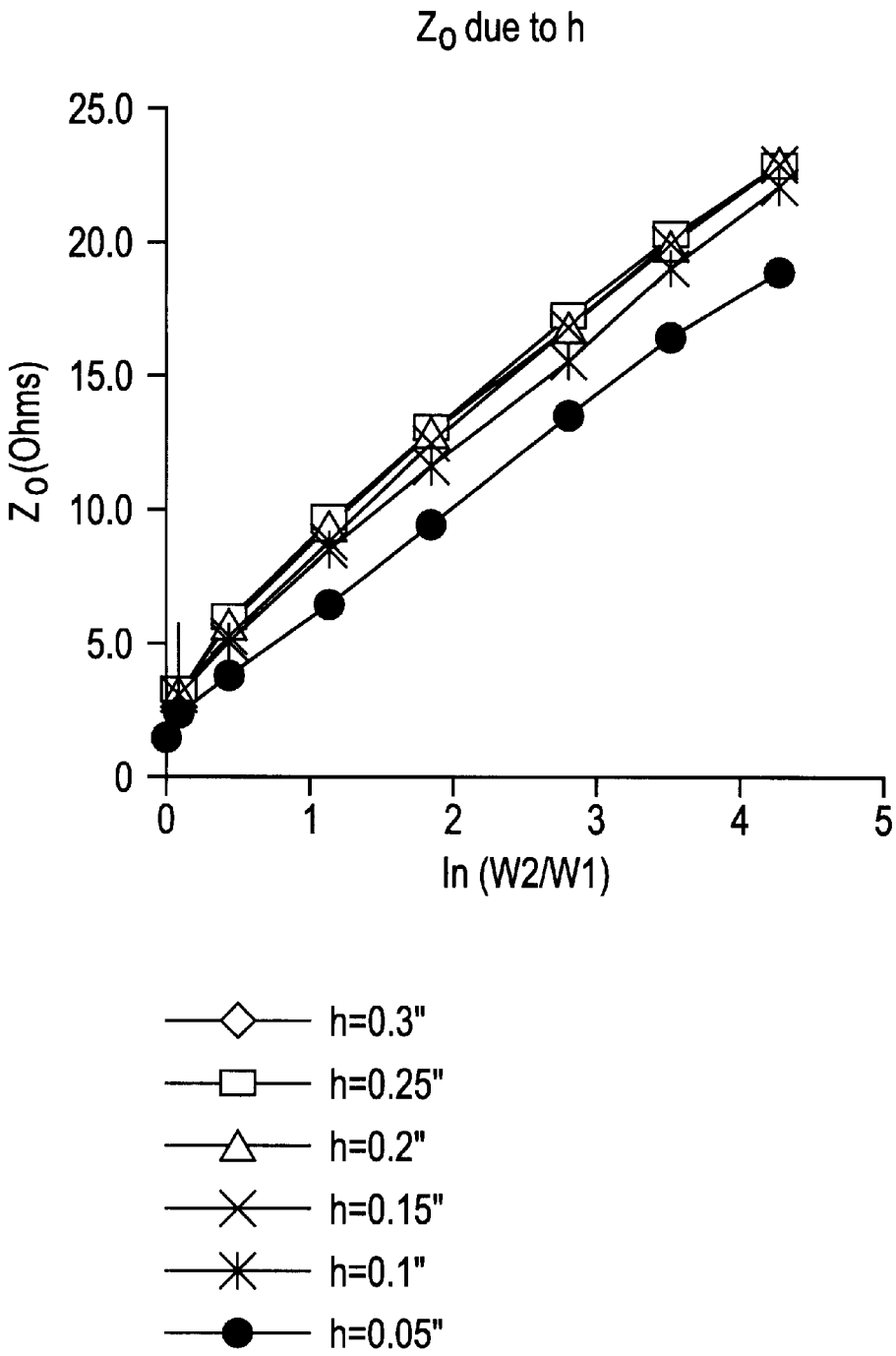
FIG. 6 is a graphical illustrates of Impedance vs. the 1n (W2/W1) for various support substrate thicknesses, according to an aspect of the present invention.

FIG. 6 illustrate Zo vs. 1n (W1/W2) for various values of H. As shown in the graph, the impedance values are correspondingly higher as the thickness of H increases. This figure illustrates that as the distance of the line to the ground plane decreases, the line approaches microstrip. However, as the line moves away from the bottom, the impedance is primarily a function of the ratio of the enclosure width W2 to the line/dielectric width W1 and energy is essentially bound by the conductor and retained in the dielectric layer. It has been found that the line ZO displays essentially the same dependence on H for a wide range of W2, and thus is primarily a function of the ratio W2/W1, for H>W1.

Accordingly, the information illustrated in FIG. 6 can be used in the design of interconnecting lines for implementing various filter topologies, as well as for excitation of the resonators. It has been found that as long as the guide wavelength has been reduced in the immediate vicinity of the below cutoff resonator (with a short length of high dielectric constant surface wave line), the majority of the interconnecting lengths of transmission line can be approximated with a lumped low pass network. This equivalent network is required to provide the same input impedance and phase shift as the transmission line that resulted from the original synthesis. This lumped equivalent network has another significant advantage: it does not display a periodic response, and thus the stopband of the bandpass or bandstop structure also does not display periodicity.

Figure 7:
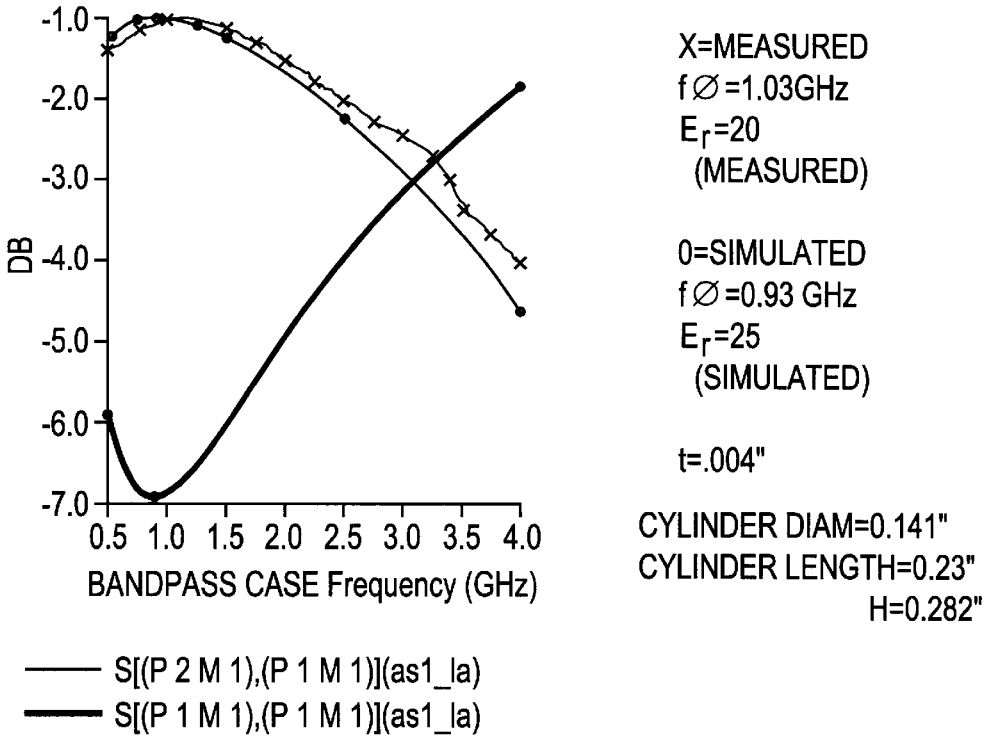
FIG. 7 provides a graphical illustration of the operation of a bandpass resonator according to an aspect of the present invention.

FIG. 7 provides a graphical illustration of the operation of a bandpass resonator according to an aspect of the present invention. The sizes of the cylinder and frequencies used are intended for purposes of illustration, not limitation, and a person of ordinary skill in the art understand that sizes could be significantly larger or smaller than shown. In this particular case , the cylinder diameter was 0.141 inches, the cylinder length 0.23 inches, and the height 0.282 inches. The cross-hatched line represents measured signal strength with a dielectric constant of (the high dielectric substrate) and a bandpass frequency of 1.03 GHz. The graph also illustrates simulated results for a dielectric constant of 25, where the bandpass frequency (resonance) is 0.93 GHz.

Figure 8:
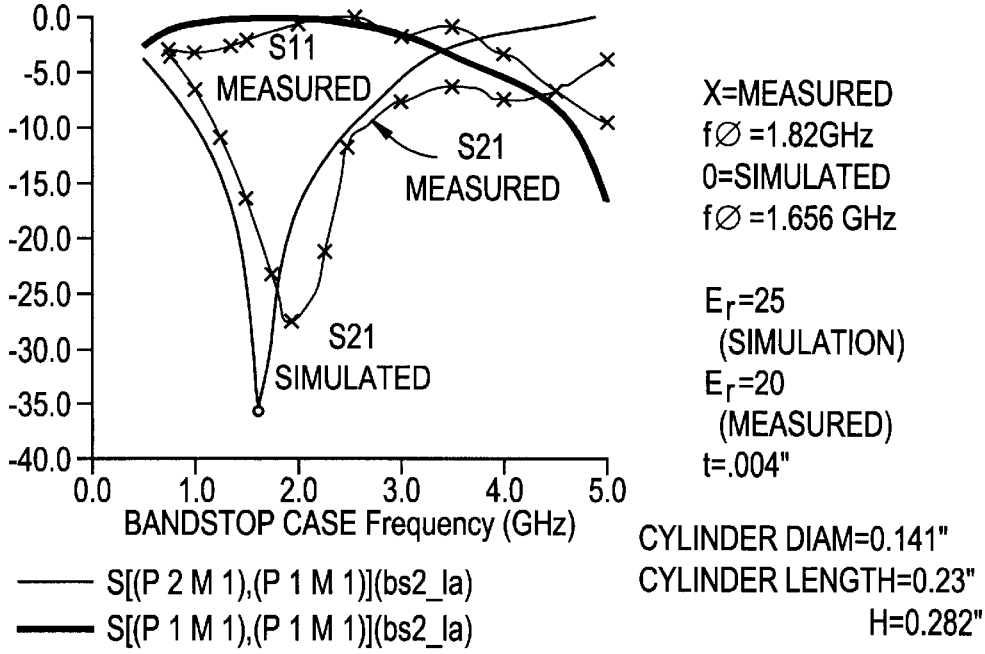
FIG. 8 provides a graphical illustration of the operation of a bandstop resonator according to an aspect of the present invention.

FIG. 8 provides a graphical illustration of the operation of a bandstop resonator according to an aspect of the present invention. The size of the cylinder and the dielectric constants are the same as described above in the discussion of FIG. 7, and this Figure shows a measured center of the bandstop frequency at 1.82 GHz, and a simulated center frequency of 1.65 GHz.

Figure 9A:
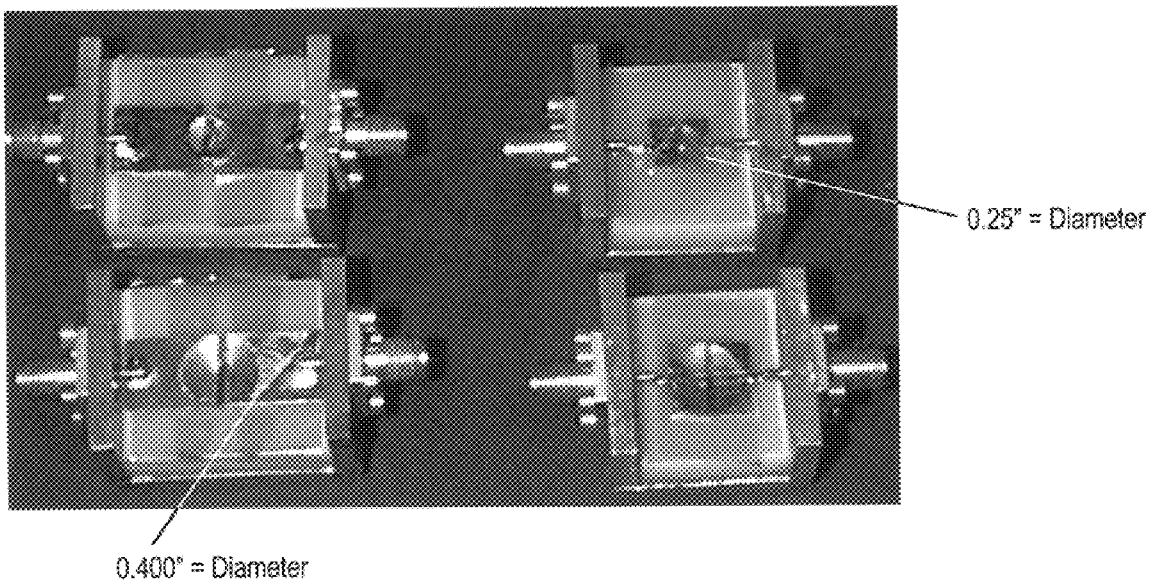
FIGS. 9A and 9B are photos of prototypes of bandpass and bandstop resonators according to the present invention.
Figure 9B:
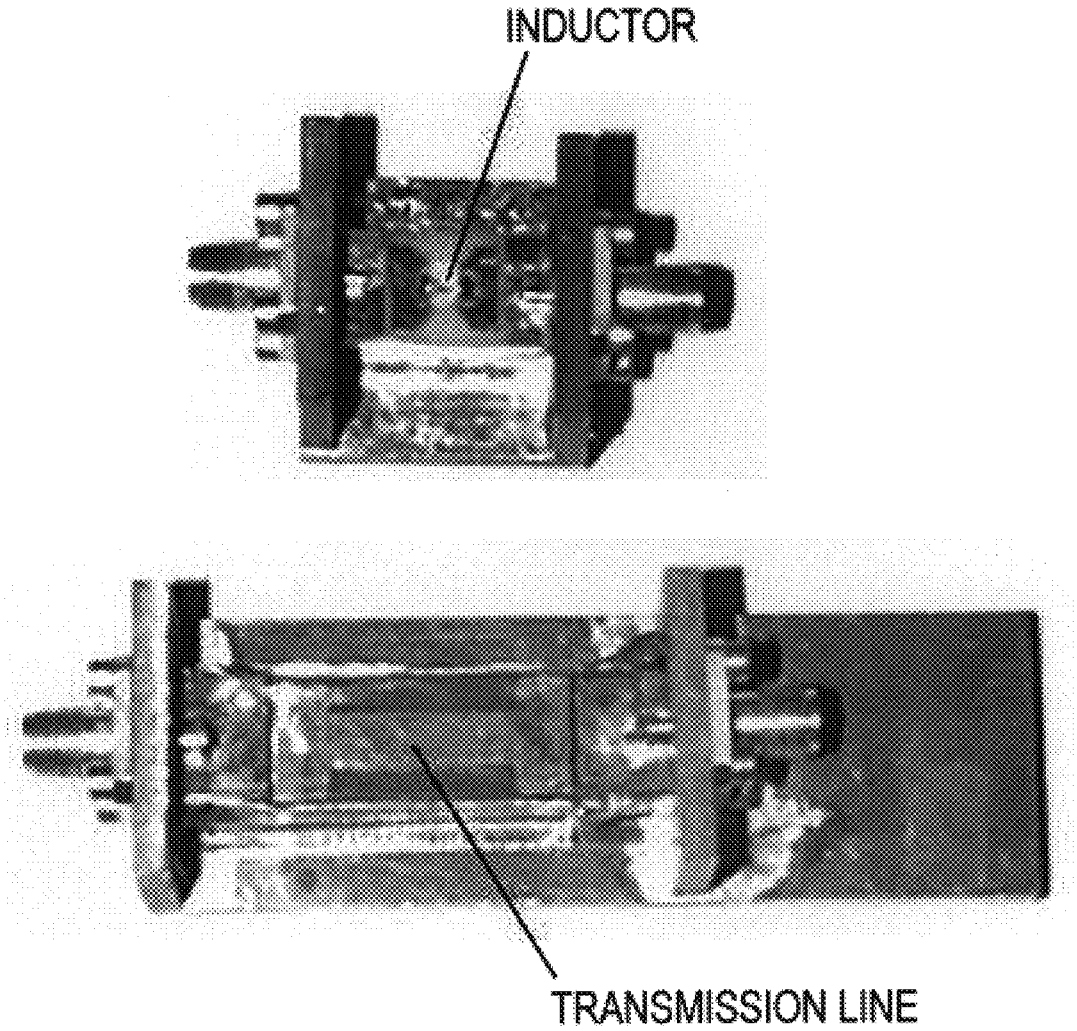

FIGS. 9A and 9B are photos of prototypes of bandpass and bandstop resonators according to the present invention. It can be seen from the photos that the resonators are relatively small in size.

Figure 10:
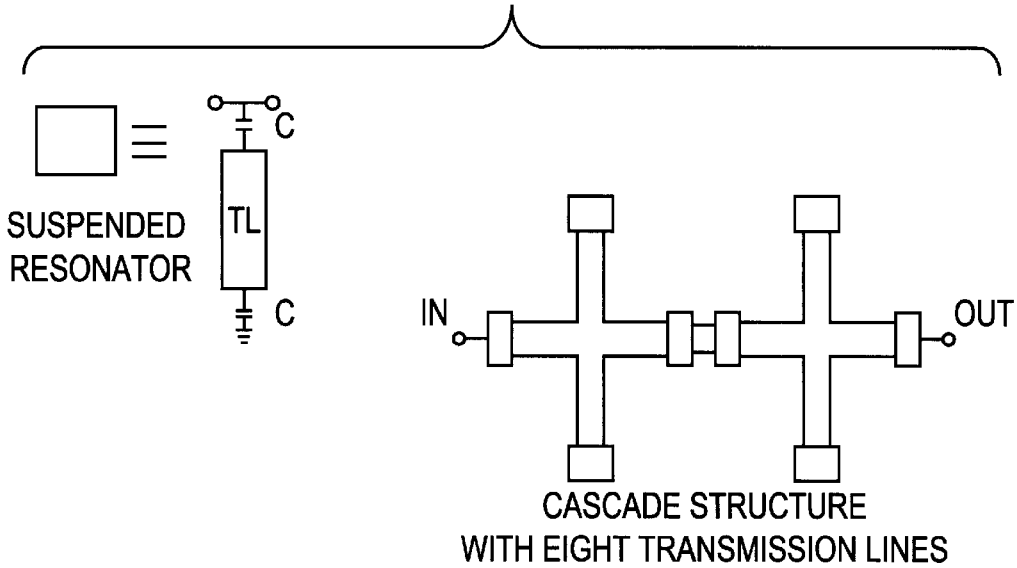
FIG. 10 illustrates one way that resonators according to the present invention can be cascaded.

FIG. 10 illustrates one way that resonators according to the present invention can be cascaded. It should be understood by persons of ordinary skill in the art that there are other ways to cascadedly connect the resonators according to the present invention.

Figure 11A:
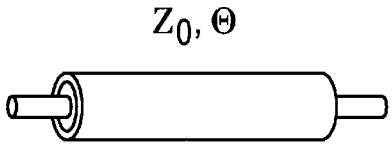
FIGS. 11A and 11B illustrate the transformation of a series transmission line into a lowpass pi-equivalent shown in FIG. 11B.
Figure 11B:
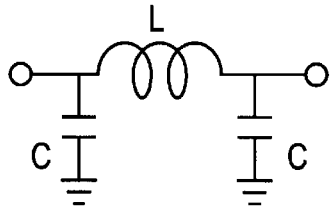

FIGS. 11A and 11B illustrate the transformation of a series transmission line into a lowpass pi-equivalent shown in FIG. 11B. The equations in FIG. 11B are using θ as a value in radians, and $\omega_\theta$ is the filter center frequency in radians. The final values are adjusted via optimization.

Figure 12A:
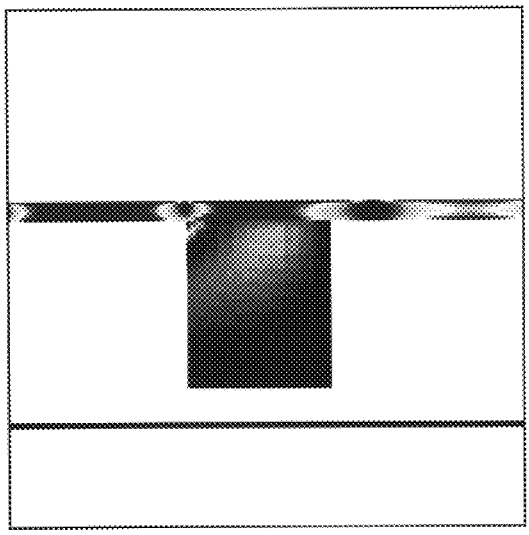
FIGS. 12A and 12B illustrate a propagating wave comparison according to the present invention.
Figure 12B:
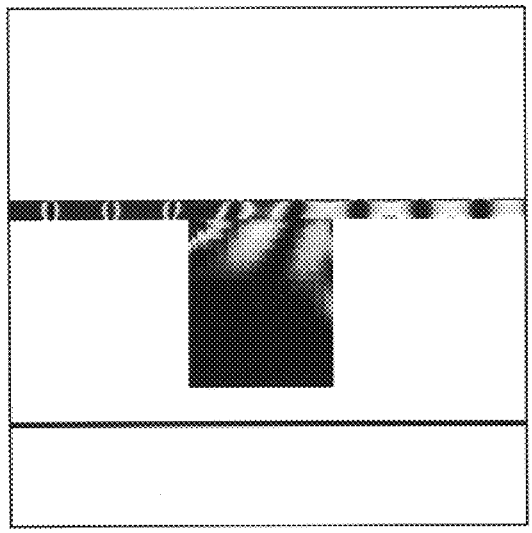

FIGS. 12A and 12B illustrate a propagating wave comparison according to the present invention. The higher shortens wavelength and has the same effect as a higher frequency with a low K, so as to increase reactance of the below cutoff resonator.

Lower Order Capacitance Term Derivation

Figure 13A:
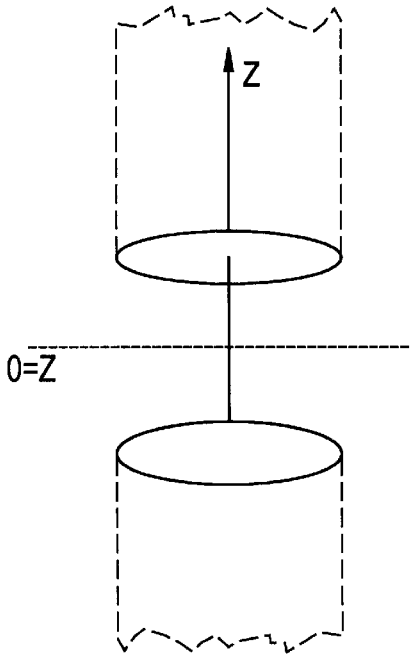
FIGS. 13A and 13B illustrates the Surface wave excitation of a cylinder resonator.
Figure 13B:
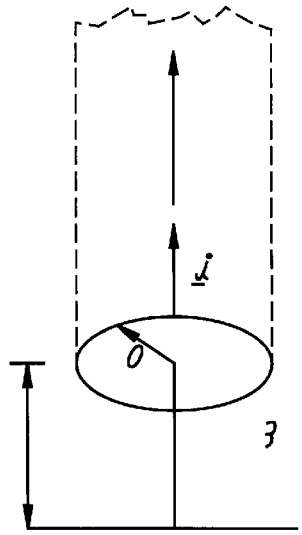

As shown in FIGS. 13A and 13B, the cylindrical resonator of radius "a" and height "l" is made of an electrical conductor. The top is covered by a dielectric layer with permittivity $\in = \in_o \in_r$ and thickness "d", where d<<a. The metal strip line on top of this layer is used to excite a surface wave. Generally, the width of the strip line exceeds the diameter of the resonator when an impedance matching is considered. In determining the lowest order term for the capacitance between the strip line and the resonator, the following assumptions are made:

the finite width of the strip line is assumed to be infinite, the induced charge on the cylinder is confined only to the rim due to its metallic nature.

The image theory is used based on the above assumptions and the equivalent image diagram is obtained (FIG. 13B) based on the original geometry of FIG. 13A.

Figure 13C:
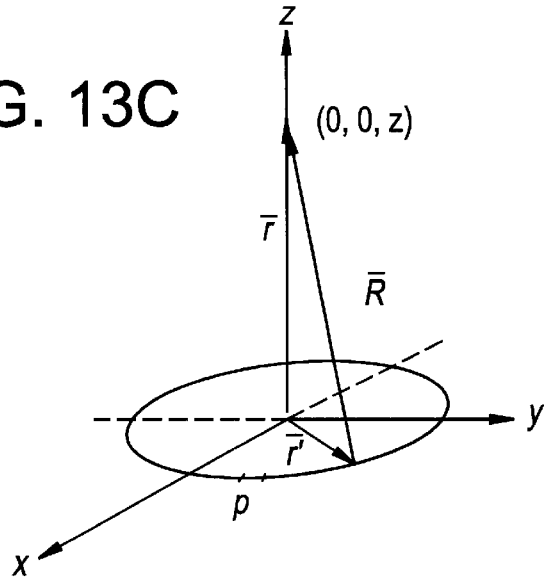
FIG. 13C illustrates the circular line charge density $\rho_l$.

In order to solve the image geometry in FIG. 13B, consider a single circular filament of charge density $\rho_l$ be located on the xy-plane as shown in FIG. 13C.

The position vectors are $\bar{r}=z\acute{z}$ and $\bar{r}'=\alpha\rho$. The corresponding distance is given as $$R=|\bar{r}-\bar{r}'|=(Z^2+a^2)^{1/2} \tag{13-1}$$

The differential electric field is given as $$d\bar{E}(\bar{r}) = \frac{1}{4\pi\varepsilon}\rho_1(\bar{r}')\frac{adl'(\bar{r}-\bar{r}')}{|\bar{r}-\bar{r}'|} \tag{13-2}$$

and the total field along the +z axis (any other observation point off the axis will require formulation in terms of elliptical functions) is $$\overline{E}(0,0,z)=\frac{1}{4\pi\varepsilon}\int_0^{2\pi}\frac{\rho_1 a d\phi'(z\hat{z}-a\hat{\rho})}{(z^2+a^2)^{3/2}}. \tag{13-3}$$

Note that $d\overline{l}'=ad\phi'$.

The evaluation of the above integral yields only a z-component of the E-field along the +z axis as $$E_z(0,0,z)=\frac{az}{2\rho}\rho_1\frac{1}{(z^2+a^2)^{3/2}} \tag{13-4}$$

Field components other than the z-component vanish due to symmetry. Using the above result in FIG. 13B for the equivalent image yields for the E-field between the rings as $$E_z=\frac{-a(d-z)\rho_1}{2\varepsilon[(d-z)^2+a^2]^{3/2}}-\frac{a(z+d)\rho_1}{2\varepsilon[(d+z)^2+a^2]^{3/2}} \tag{13-5}$$

and the resulting potential difference between the two rings can be obtained as $$V_0=-\int_{-d}^{d}\overline{E}\cdot d\overline{l}=\frac{a\rho_1}{\varepsilon}\left[\frac{1}{a}-\frac{1}{(4d^2+a^2)^{1/2}}\right] \tag{13-6}$$

Since the total charge on any ring is $$|Q|=\rho_l 2\pi\alpha$$

Then the equivalent capacitance is $$C=\frac{|Q|}{V_0}=\frac{2\pi\varepsilon a[4d^2+a^2]^{1/2}}{(4d^2+a^2)^{1/2}-a}. \tag{13-7}$$

The dielectric loading thus has the effect of allowing resonance at lower frequencies without using large resonation capacitors. Furthermore, the dielectric loading does not sacrifice a major advantage of evanescent resonant structures: very wide stopbands, because spurious passbands do not occur until frequencies exceed the cutoff frequency of the below cutoff section. The cutoff frequency of the below cutoff section is not affected by the dielectric loading of the feedlines.

Various modifications may be made by persons of ordinary skill in the art that do not depart from the spirit of the innovation do the scope of the appended claims. For example, the dielectric constant of the substrates, thickness of the support substrate, widths of the dielectric feed network can have variations than those illustrated. In addition, the operable frequencies may also be significantly lower or higher than the 1–2 GHz range. An advantage of the present invention is that the structure avoids the intrinsic unload Q reduction present in the prior art, and the resonator is suitable, inter alia, for inclusion in planar or almost planar networks with transmission zeros and poles both realizable directly from the two circuit forms. Also, the circuit arrangements of the bandpass and bandstop configurations are provided for illustrative purposes only, and it is to be understood by persons of ordinary skill in the art that there are many configurations/combinations of the evanescent resonator of the present invention possible, all of which lie squarely within the spirit of the invention and the scope of the appended claims.

What is claimed is:

1. A evanescent resonator device comprising:

a short-circuited evanescent waveguide including a single length of evanescent transmission line that is terminated in short circuit; and a loading capacitance;

wherein said evanescent waveguide includes:

a first support substrate having a predetermined dielectric constant, said first support substrate having a top surface and a bottom surface;

wherein said loading capacitance comprises a dielectrically loaded feed network with a shortened guide wavelength, including:

(a) a second substrate arranged on the top surface of said first support substrate, said second substrate having a predetermined dielectric constant that is higher than said first support substrate; and (b) a metal strip arranged on an upper surface of said second substrate, so that said second substrate is arranged between said first support substrate and said second substrate;

a ground plane arranged on the bottom surface of said first support substrate;

wherein said first support substrate includes a hollow metalized center area being open on an upper end closest to said second substrate; and wherein a ratio of the predetermined dielectric constants of said second substrate to said first support substrate ranges from approximately 2 to 200.

2. The device according to claim 1, wherein the predetermined dielectric constant of said second substrate ranges from 4.5 to 400.

3. The device according to claim 1, wherein the predetermined dielectric constant of said first support substrate ranges from approximately 2 to 3.

4. The device according to claim 1, wherein the hollow metalized center area of said first support substrate is one of cylindrically shaped, elliptically shaped, rectangularly shaped, and polygon-shaped.

5. The device according to claim 1, wherein the shortened guide wavelength is a predetermined value so that an excitation wavelength by dielectric loading is not required to operate the resonator at frequencies below predetermined frequencies associated with a particular dimension and loading capacitance.

6. A bandpass resonator device comprising a plurality of evanescent resonators according to claim 1, wherein the plurality of evanescent resonators are arranged in a series transmission pole configuration.

7. A bandstop resonator device comprising a plurality of evanescent resonators according to claim 1, wherein the plurality of evanescent resonators are arranged in a shunt transmission zero to ground configuration.

8. The device according to claim 1, wherein at least a propagation constant $\gamma$ of the resonator depends on a ratio of the shortened feedguide wavelength to a cutoff wavelength.

9. A filter device comprising a plurality of resonators according to claim 1, wherein said plurality of resonators comprising at least one each of bandpass and bandstop resonators arranged together.

10. The filter device according to claim 9, wherein said plurality of resonators are arranged in a transmission line connection configuration.

11. The filter device according to claim 9, wherein said plurality of resonators are arranged in a lumped equivalent connection configuration.

12. The device according to claim 1, wherein the metal strip has a gap axially aligned with the hollow metalized center area.

13. The device according to claim 1 wherein, a lower end of the hollow metalized center area is in contact with the ground plane.

14. The device according to claim 4, wherein the lower end of the hollow metalized center area is not in contact with the ground plane.

15. The device according to claim 1, wherein said first support substrate has a height H, and a wider width (W2) than a width of said metal strip (W1).

16. The device according to claim 15, wherein for H>W1 for a surface wave.

17. The device according to claim 15, wherein a wavelength of the dielectric feed network is only slightly larger than a wavelength of a cutoff wavelength of the resonator so that said resonator operates at values approximate to but below the cutoff wavelength.

18. The device according to claim 15, wherein a width of said second support substrate is at least as wide as the width of said metal strip.

19. The device according to claim 1, wherein the center of said first support substrate has more than one hollow metalized area.

20. The device according to claim 1, wherein said first support substrate has more than one hollow metalized cylindrical shape in the center area.

21. The device according to claim 1, wherein said resonator comprises one of a bandpass and a bandstop resonator being operable at frequencies less than 1 GHz.

22. The device according to claim 1, wherein said resonator comprises one of a bandpass and a bandstop resonator being operable at frequencies between approximately 100 MHz and 10 GHz.

23. The device according to claim 1, wherein the dielectrically loaded feed line comprises one of microstrip, co-planar resonator (CPW), co-planar stripline (CPS), and Goubau lines.

24. The device according to claim 1, wherein the first support substrate comprises Teflon (PTFE).

25. A multi-resonator comprising a plurality of cascaded resonators according to claim 1, wherein the plurality of cascaded resonators are externally connected.

26. A multi-resonator comprising a plurality of cascaded evanescent resonators according to claim 18, said cascaded resonators being arranged on a microchip.

27. A method of manufacturing a resonator device comprising:

(a) providing an evanescent waveguide section terminated in short-circuit, said evanescent waveguide section comprising a first support substrate having a predetermined dielectric constant, and said first support substrate having a top surface and a bottom surface;

(b) arranging a loading capacitance comprising a dielectrically loaded feed network with a shortened guide wavelength on the top surface of the first support substrate, said dielectrically loaded feed network comprising:

(i) a second substrate arranged on the top surface of said first support substrate, said second substrate having a predetermined dielectric constant that is higher than said first support substrate; and (ii) a metal strip arranged on an upper surface of said second substrate, so that said second substrate is arranged between said first support substrate and said second substrate;

(c) arranging a ground plane on the bottom surface of said first support substrate;

wherein said first support substrate is provided with a hollow metalized center area being open on an upper end closest to said second substrate; and wherein a ratio of the predetermined dielectric constants of said second substrate to said first support substrate ranges from approximately 2 to 200.

28. The method according to claim 27, wherein the predetermined dielectric constant of said second substrate provided in step (b) ranges from 4.5 to 400.

29. The method according to claim 27, wherein the predetermined dielectric constant of said first support substrate provided in step (a) ranges from approximately 2 to 3.

30. The method according to claim 27, wherein the hollow metalized center area of said first support substrate is cylindrically shaped.

31. The method according to claim 27, wherein the hollow metalized center area of said first support substrate is elliptically shaped.

32. The method according to claim 27, wherein the hollow metalized center area of said first support substrate is rectangularly shaped.

33. The method according to claim 27, wherein the hollow metalized center area of said first support substrate polygon-shaped.

34. The method according to claim 27 wherein the metal strip has a gap axially aligned with the hollow metalized center area.

35. The method according to claim 27 wherein, a lower end of the hollow metalized center area is in contact with the ground plane.

36. The method according to claim 27, wherein the lower end of the hollow metalized center area is not in contact with the ground plane.

37. The method according to claim 27, wherein said first support substrate has a wider width (W2) than a width of said metal strip (W1).

38. The method according to claim 37, wherein a width of said second support substrate is at least as wide as the width of said metal strip.

39. The method according to claim 27, wherein the center of said first support substrate has more than one hollow metalized area.

40. The method according to claim 27, wherein said first support substrate has more than one hollow metalized cylindrical shape in the center area.

41. The method according to claim 27, wherein said resonator comprises one of a bandpass and bandstop resonator being operable at frequencies less than 1 GHz.

42. The method according to claim 27, wherein said resonator comprises one of a bandpass and a bandstop resonator being operable at frequencies between approximately 100 MHz and 10 GHz.

43. The method according to claim 27, wherein the dielectrically loaded feed line comprises one of microstrip, co-planar resonator (CPW), co-planar stripline (CPS), and Goubau lines.

44. The method according to claim 27, wherein the first support substrate comprises Teflon (PTFE).

45. The method according to claim 27, wherein the hollow metalized center area is micro-machined into the first support substrate.

46. The method according to claim 27, wherein said first support substrate has a height H, and a wider width (W2) than a width of said metal strip (W1).

47. The method according to claim 27, wherein for H>W1 for a surface wave.

48. The method according to claim 27, wherein a size of the dielectrically loaded feed network is selected so that a wavelength of the dielectric feed network is only slightly larger than a wavelength of a cutoff wavelength of the resonator so that said resonator operates at values approximate to but below the cutoff wavelength.

49. The method according to claim 27, further comprising cascading at least two resonator devices into a multi-resonator structure by an external connection.

50. The method according to claim 27, wherein the dielectric substrates comprise ferroelectric dielectrics.

51. The method according to claim 27, further comprising:

(d) the loading capacitance in step (d) is selected so that a reduction in excitation wavelength is not required to operator the resonator at frequencies below predetermined frequencies associated with a particular dimension and loading capacitance of the resonator.

52. The method according to claim 27, further comprising:

(d) arranging a plurality of resonators in a series transmission pole configuration.

53. The method according to claim 27, further comprising:

(d) arranging a plurality of resonators in a shunt transmission to zero ground configuration.

54. The method according to claim 27, further comprising (d) selecting at least a propagation constant $\gamma$ of the resonator dependent on a ratio of the shortened feedguide wavelength to a cutoff wavelength.

55. The method according to claim 27, further comprising:

connecting a plurality of evanescent resonators provided according to steps (a) to (c) in at least one of a bandstop and bandpass configuration.

56. The method according to claim 27, further comprising:

(d) arranging a plurality of evanescent resonators provided according to steps (a) to (c) in a transmission line connection configuration.

57. The method according to claim 27, further comprising:

(d) arranging a plurality of evanescent resonators provided according to steps (a) to (c) in a lumped equivalent connection configuration.

58. An evanescent resonator according to the process of claim 27.

59. An evanescent resonator according to the process of claim 42.

60. An evanescent resonator according to the process of claim 45.

61. An evanescent resonator according to the process of claim 46.

62. A microchip comprising at least one evanescent resonator according to claim 27.

63. A microchip comprising at least one evanescent resonator according to claim 42.

* * * * *